US008453813B2

(12) United States Patent
Lai

(10) Patent No.: US 8,453,813 B2
(45) Date of Patent: Jun. 4, 2013

(54) TRAVEL BAG

(76) Inventor: Wei-Hung Lai, Taichung (TW)

( * ) Notice: Subject to any disclaimer, the term of this patent is extended or adjusted under 35 U.S.C. 154(b) by 38 days.

(21) Appl. No.: 13/280,442

(22) Filed: Oct. 25, 2011

(65) Prior Publication Data

US 2013/0098721 A1 Apr. 25, 2013

(51) Int. Cl.
*A45C 5/06* (2006.01)

(52) U.S. Cl.
USPC ..... 190/110; 190/109; 190/111; 190/124; 190/903

(58) Field of Classification Search
CPC ..... A45C 5/06
USPC ..... 190/110, 109, 111
See application file for complete search history.

(56) References Cited

U.S. PATENT DOCUMENTS 2,180,191 A * 11/1939 Bauch ..... 190/111
2,797,719 A * 7/1957 Hume ..... 150/117
5,875,876 A * 3/1999 Wang ..... 190/18 A
6,481,574 B1 * 11/2002 Pakosh ..... 206/285
6,655,565 B2 * 12/2003 Godshaw et al. ..... 224/653
6,837,346 B2 * 1/2005 Hollingsworth ..... 190/11
6,923,302 B2 * 8/2005 Godshaw et al. ..... 190/109
7,900,758 B2 * 3/2011 King et al. ..... 190/112
D640,868 S * 7/2011 Jongchul ..... D3/279
8,104,594 B2 * 1/2012 Chisholm ..... 190/112
2004/0108179 A1 * 6/2004 Scicluna et al. ..... 190/109
2008/0087513 A1 * 4/2008 Majeau ..... 190/111
2010/0213020 A1 * 8/2010 Lynch-Ringvold ..... 190/110
2010/0219221 A1 * 9/2010 Zheng ..... 224/576
2011/0011761 A1 * 1/2011 Enmon ..... 206/320
2011/0174584 A1 * 7/2011 Bedard ..... 190/109
2011/0186396 A1 * 8/2011 Sheikh ..... 190/111

* cited by examiner

*Primary Examiner* — Tri Mai
(74) *Attorney, Agent, or Firm* — Rosenberg, Klein & Lee

(57) ABSTRACT

A travel bag includes a bag body defining a front open side, a cover panel covered on the front open side of the bag body, a first zipper joining the cover panel and the bag body, a locating panel mounted in a center opening in the cover panel, a connection frame stitched to the locating panel, a sub cover panel hinged to the bottom side of the connection flap, a second zipper joining the sub cover panel and the locating panel, a partition panel set in a center opening in the connection frame, a third zipper joining the connection frame and the partition panel, and two fan-like expandable side flats bilaterally connected between the connection frame and the sub cover panel.

1 Claim, 4 Drawing Sheets

TRAVEL BAG

BACKGROUND OF THE INVENTION

1. Field of the Invention

The present invention relates to travel bags and more particularly to an improved structure of travel bag, which defines therein multiple storage spaces for keeping classified personal items and allows opening of the front cover panel for access to internal storage spaces when kept in vertical.

2. Description of the Related Art

A conventional travel bag, as shown in FIG. 1, generally comprises a plastic bag body 1, a flexible front cover panel 2 and a zipper 3 joining the plastic bag body 1 and the flexible front cover panel 2. This design of travel bag has drawbacks as follows:

1. When the user opens the flexible front cover panel 2 from the plastic bag body 1 in order to pick up one particular storage item, all the storage items are exposed to the outside. It will be bothersome to expose certain personal storage items (such as underwear) to the public.
2. When going to open the flexible front cover panel 2 from the plastic bag body 1, the user must lie the travel bag flat on the floor otherwise storage items will fall out of the travel bag to the floor. Lying the travel bag flat on the floor occupies much floor space.
3. The flexible front cover panel 2 does not have any peripheral protective structure and therefore it may be deformed or damaged easily.

SUMMARY OF THE INVENTION

The present invention has been accomplished under the circumstances in view. It is the main object of the present invention to provide a travel bag, which defines therein multiple storage spaces for keeping classified personal items. It is another object of the present invention to provide a travel bag, which allows opening of the front cover panel when kept in vertical.

To achieve these and other objects of the present invention, the travel bag comprises a bag body defining a front open side, a cover panel covered on the front open side of the bag body, a first zipper joining the cover panel and the bag body, a locating panel mounted in a center opening in the cover panel, a connection frame stitched to the locating panel, a sub cover panel hinged to the bottom side of the connection flap, a second zipper joining the sub cover panel and the locating panel, a partition panel set in a center opening in the connection frame, a third zipper joining the connection frame and the partition panel, and two fan-like expandable side flats bilaterally connected between the connection frame and the sub cover panel.

DETAILED DESCRIPTION OF THE PREFERRED EMBODIMENT

Figure 1:
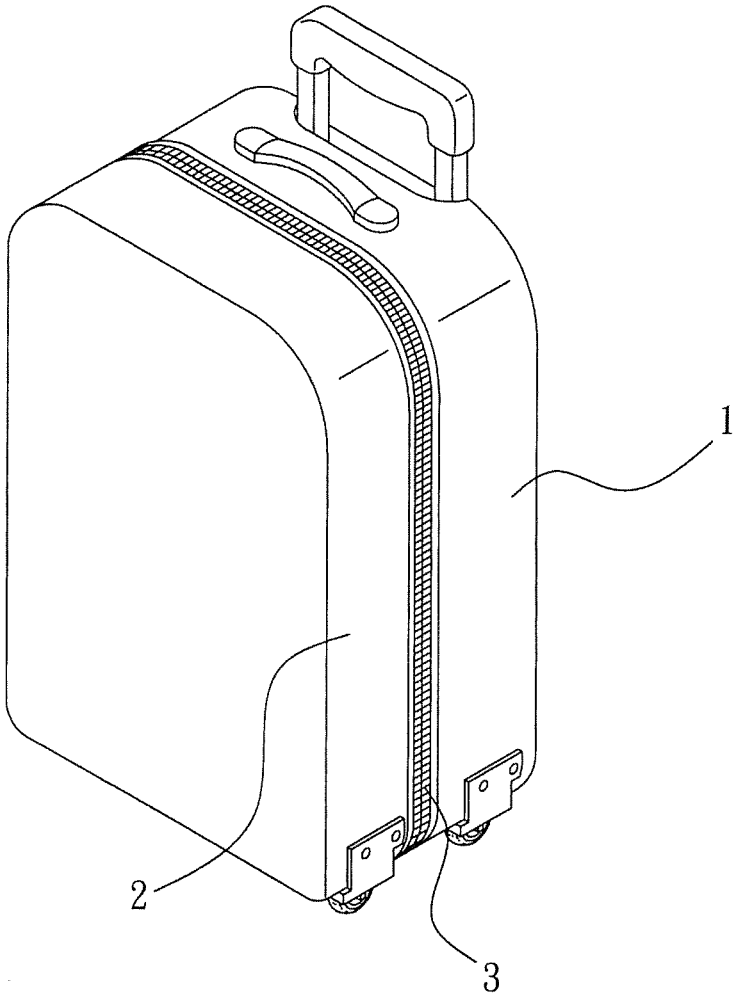
FIG. 1 PRIOR ART
FIG. 1 is an oblique elevational view of a bag according to the prior art.
Figure 2:
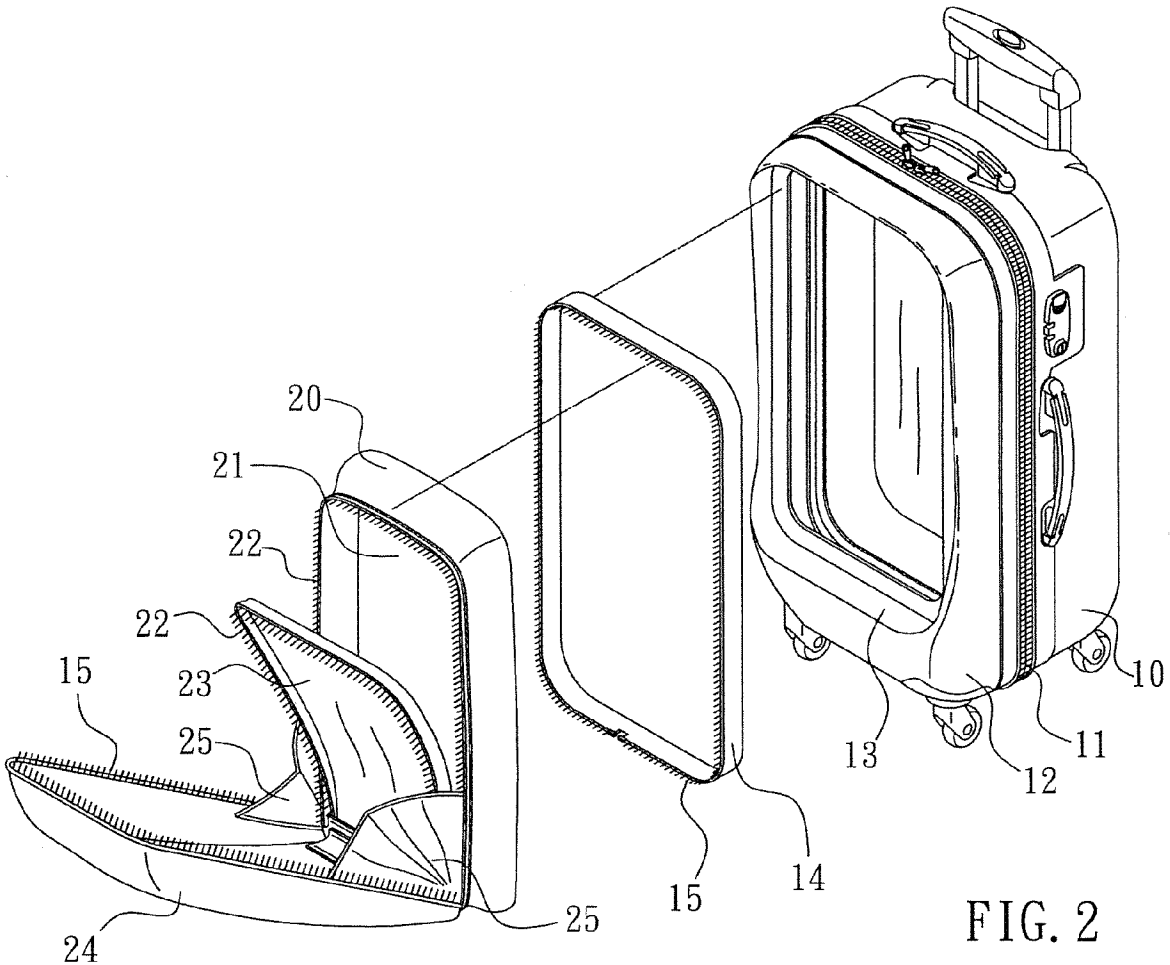
FIG. 2 is an exploded view of a travel bag in accordance with the present invention.

Referring to FIGS. 2~5, a travel bag in accordance with the present invention is shown comprising a bag body 10, a cover panel 12 covered on the front open side of the bag body 10 and defining therein a center opening 13, a first zipper 11 joining the cover panel 12 and the bag body 10, a locating panel 14 mounted in the center opening 13, a connection frame 20 stitched to the locating panel 14 and defining therein a center opening 21, a sub cover panel 24 hinged to the bottom side of the connection frame 20, a second zipper 15 joining the sub cover panel 24 and the locating panel 14, a partition panel 23 set in the center opening 21 inside the connection frame 20, a third zipper 22 joining the connection frame 20 and the partition panel 23, and two fan-like expandable side flats 25 bilaterally connected between the connection frame 20 and the sub cover panel 24.

Figure 4:
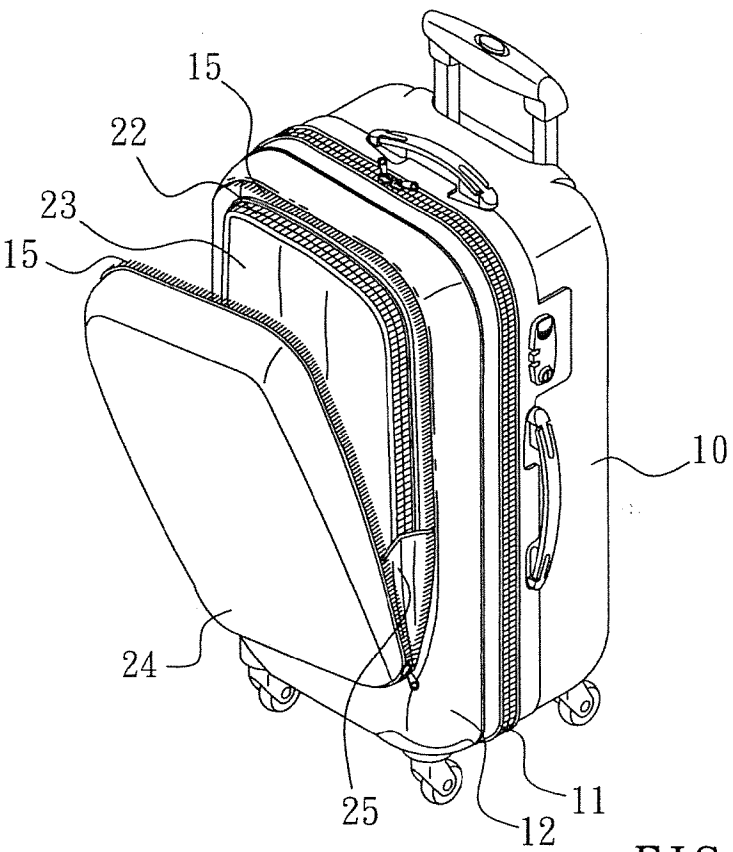
FIG. 4 is a schematic operational view of the present invention, illustrating an operation status of the travel bag.
Figure 3:
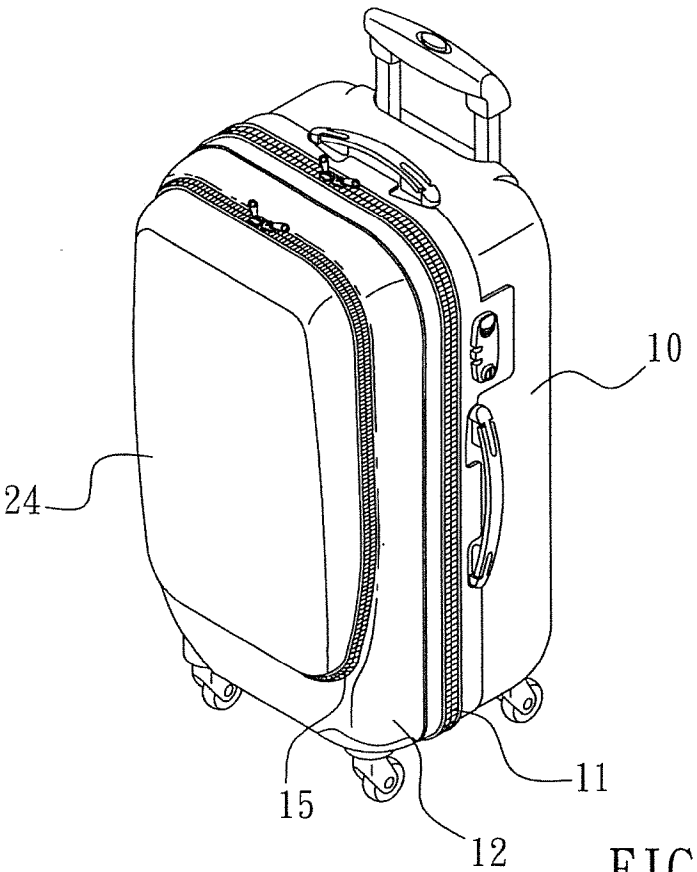
FIG. 3 is an elevational assembly view of the travel bag in accordance with the present invention.
Figure 5:
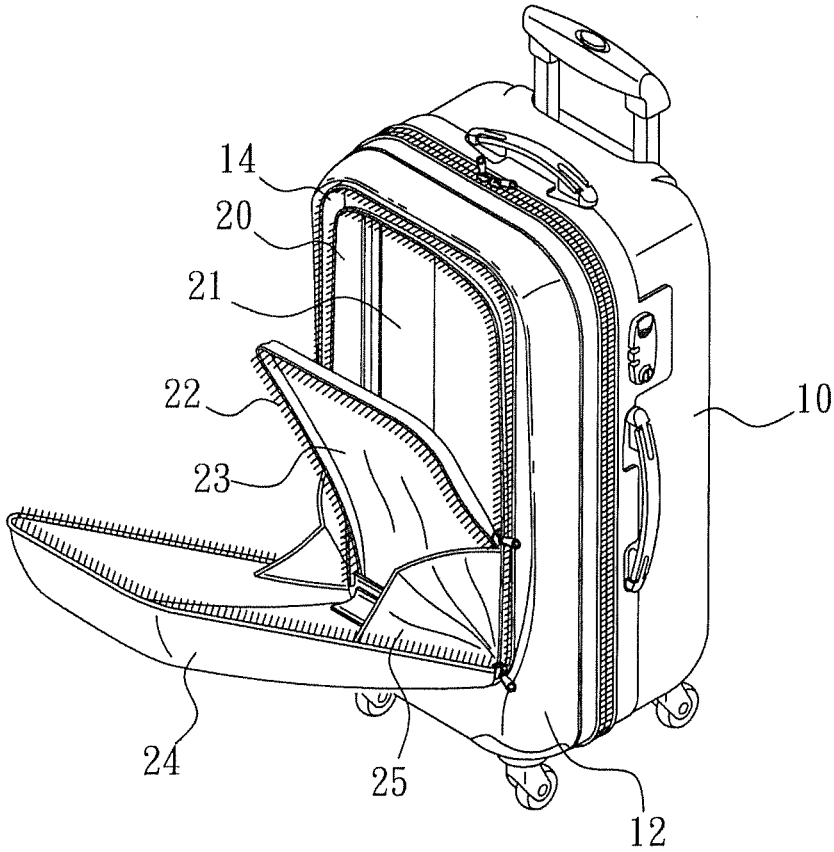
FIG. 5 is a schematic operational view of the present invention, illustrating another operation status of the travel bag.

The travel bag has the following features and advantages:

1. As shown in FIG. 4, an extra storage space is defined between the sub cover panel 24 and the partition panel 23 for keeping personal items. When wishing to pick up one storage item from the storage space in between the sub cover panel 24 and the partition panel 23, it is not necessary to open the storage space defined in between the cover panel 12 and the bag body 10.
2. As shown in FIG. 5, when wishing to pick up one storage item from the bag body 10, the user can open the sub cover panel 24 and the partition panel 23 (i.e., the second zipper 15 and the third zipper 22) conveniently.
3. As shown in FIG. 3, the sub cover panel 24 and the partition panel 23 are disposed at the front side of the cover panel 12 to give protection.
4. As show in FIG. 4, the user can open the cover panel 12, the sub cover panel 24 and the partition panel 23 (i.e., the first zipper 11, the second zipper 15 and the third zipper 22) without lying the travel bag flat on the floor, keeping the travel bag clean.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A travel bag, comprising a bag body defining a front open side, a cover panel covered on the front open side of said bag body, said cover panel defining therein a center opening, a first zipper joining said cover panel and said bag body, a locating panel mounted in the center opening of said cover panel, a connection frame stitched to said locating panel, said connection frame defining therein a center opening, a sub cover panel hinged to a bottom side of said connection frame, a second zipper joining said sub cover panel and said locating panel, a partition panel set in the center opening of said connection frame, a third zipper joining said connection frame and said partition panel, and two fan-like expandable side flats bilaterally connected between said connection frame and said sub cover panel.

* * * * *